US005374036A

United States Patent [19]

Rogers et al.

[11] Patent Number: 5,374,036

[45] Date of Patent: Dec. 20, 1994

[54] METALLURGICAL POURING VESSELS

[75] Inventors: Norman E. Rogers, Derbyshire; Liam Cullen, Birmingham, both of England

[73] Assignee: Foseco International Limited, Birmingham, England

[21] Appl. No.: 131,631

[22] Filed: Oct. 5, 1993

[30] Foreign Application Priority Data

Oct. 27, 1992 [GB] United Kingdom ..... 9222548

[51] Int. Cl.[5] ..... B22D 41/46

[52] U.S. Cl. ..... 266/45; 266/272; 222/590; 222/597

[58] Field of Search ..... 266/44, 45, 271, 272, 266/236; 222/590, 591, 597, 600

[56] References Cited

U.S. PATENT DOCUMENTS

| | | | |
|---|---|---|---|
| 4,913,404 | 4/1990 | Warman | 266/272 |
| 4,984,769 | 1/1991 | Bruckner et al. | 266/272 |

FOREIGN PATENT DOCUMENTS

| | | | |
|---|---|---|---|
| 2247303 | 5/1975 | France . | |
| 0280270 | 7/1990 | Germany | 222/600 |
| 0003731 | 2/1978 | Japan | 222/600 |
| 0278957 | 11/1989 | Japan | 222/597 |
| 1581058 | 12/1980 | United Kingdom | 222/600 |
| 2120588 | 12/1983 | United Kingdom . | |
| 2226262 | 6/1990 | United Kingdom . | |
| WO80/01659 | 8/1980 | WIPO . | |

*Primary Examiner*—Scott Kastler
*Attorney, Agent, or Firm*—Nixon & Vanderhye

[57] ABSTRACT

A method and product improve the positioning of loose anti-skulling material in the outlet nozzle zone of a metallurgical pouring vessel. The formation of skull in the outlet nozzle zone of a metallurgical pouring vessel is inhibited by positioning in the outlet nozzle zone an elongated container containing loose anti-skulling material, the container being formed of an intumescent material so that when heated it expands to fill the gap between itself and the walls of the nozzle and releases the anti-skulling material.

21 Claims, 2 Drawing Sheets

METALLURGICAL POURING VESSELS

This invention relates to metallurgical pouring vessels having closable outlet nozzles and particularly to the inhibition of skull in the nozzle zone, i.e. the space between the-inner side of the outlet and an external closure means.

Molten steel in a ladle having a closed outlet nozzle tends to cool and solidify in the nozzle zone to form what is known as 'skull' and this may partly or completely block the outlet when the outlet is opened. It is known to try to avoid this problem by putting into the nozzle zone from its inner side and with the ladle upright, particulate high melting point matter (known as 'anti-skulling material') before the steel is introduced into the ladle. This, however, for reasons explained below is not entirely satisfactory.

It has also been proposed to place loose anti-skulling material in an elongated container and to place the container in the nozzle zone of an outlet of a vessel for molten metal whereby the loose material fills the desired space in the nozzle zone, either by pouring from the container when the vessel is rotated to an upright position or on destruction of the container on heating.

These container proposals have the advantage of placing the anti-skulling material more accurately where it is desired in contrast to the previous methods of introducing it from the inner side of the vessel. Accurate positioning from the inner side is very difficult and there is a risk of the nozzle zone being provided with insufficient material to do the job properly or with excess material and, hence, waste. Nevertheless, the prior container proposals have not been entirely successful and the present invention aims to provide an improvement of that type.

Accordingly, in one aspect the invention provides a method of inhibiting the formation of skull in the outlet nozzle zone of a metallurgical pouring vessel having an outlet nozzle in which an elongated container is formed from an intumescent material, is filled with loose anti-skulling material, the container is placed in the nozzle zone to extend along the bore of the nozzle and under the influence of heat it expands to fill the gap between the container and the nozzle walls defining the bore, thereby releasing the anti-skulling material.

In another aspect the invention provides a container for use in the outlet nozzle zone of a metallurgical pouring vessel, the container being of size to contain sufficient loose anti-skulling material to fill adequately the nozzle zone and being formed of intumescent material which will expand on heating to contact the nozzle walls and release the anti-skulling material.

The container may be longer than the length of the nozzle zone so that after insertion it extends into the interior of the vessel, the required container length being determined by the volume of anti-skulling material required to fill adequately the nozzle zone after expansion of the container.

The ends of the container may be closed by any suitable means, e.g. by caps of readily heat-destructible material.

The intumescent material from which the container is made may be, for example, based on exfoliated graphite, expandable mica or expandable perlite. Exfoliated graphite is a preferred material and suitable compositions may be, for example, as follows.

| | % range by wt | Examples |
|---|---|---|
| expandable graphite | 15–70 | |
| organic binder | 5–40 | natural or synthetic rubber latices |
| inorganic fibrous | 0–30 | glass fibres, alumino-material silicate fibres |
| fire and smoke suppressant | 0–30 | aluminium hydroxide, zinc borate. |

Where expandable mica is used suitable compositions may be, for example, as follows.

| | % range by wt | Examples |
|---|---|---|
| expandable mica | 30–85 | vermiculite |
| inorganic binder | 10–70 | tetrasflicic fluorine mica, asbestos, bentonite, hectorite or saponite |
| organic binder | 0–30 | natural or synthetic rubber latices |
| inorganic fibrous | 0–60 | glass fibres, alumino-material silicate fibre, asbestos. |

Compositions based on expandable perlite may be similar to those based on expandable mica.

The containers of the invention preferably have a wall thickness of from 1 to 4 mm, i.e. a thickness of that mount of intumescent material. They may be formed by any convenient means but in a preferred embodiment the composition containing the intumescent material is cast into seamless tubular form. Alternatively, a sheet of the intumescent material of the desired thickness may have an opposed pair of edges joined, e.g. by tape, to give a tubular form.

The loose anti-skulling material may be any conventionally used for this purpose. It is preferably based on a mixture of chromite sand and silica sand and may contain further desired additives, e.g. a minor proportion of carbon black. Up to 0.5% by weight of carbon black is sufficient to coat all the particulates in the anti-skulling material and has the benefit of reducing the sintering rate in contact with molten metal.

Preferably the anti-skulling material contains from 60 to 80% by weight of chromite sand.

BRIEF DESCRIPTION OF THE DRAWINGS

The invention is further illustrated, by way of example only, by the accompanying drawings, in which:

In FIG. 1, the shell 10 of a ladle has a conventional refractory lining 12. A centrally-bored nozzle well block 16 is fitted into a suitable recess 14 in the lining 12 and a inner nozzle 18 is fitted into the central bore of well block 16 and into a corresponding hole in shell 10 of the ladle. The bore 20 of inner-nozzle 18 communicates with bore 20A of a sliding gate valve assembly 22, shown in the open configuration in FIG. 1. Sliding gate valve 22 comprises an upper fixed plate 22B mounted by conventional means to the underside of shell 10 and a slidable lower plate 22A.

In FIG. 2 is shown the device of FIG. 1 with the sliding gate valve 22 in the closed position. An elongated container 24 made of exfoliated graphite and filled with loose anti-skulling material 26 has been placed in bore 20. Its lower end rests on plate 22A of the sliding gate valve and its upper end protrudes above the level of lining 12 into the interior of the ladle. The container is of such a diameter as to not completely fill bore 20 but is a loose fit in the bore.

FIG. 3 shows the subsequent stage after the nozzle zone has been heated. The intumescent material of container 24 has expanded to closely fill and contact bore 20 and the container has effectively disintegrated to allow loose anti-skulling material 26 to fill the nozzle zone. Thus, the container has effectively disappeared leaving a thin carbon coating 27 on the walls of bore 20. Its expansion into close contact with the walls of the bore ensured that the loose anti-skulling material filled the entire nozzle zone without risk of gaps or channels into which molten steel could subsequently run and form skull.

FIG. 4 shows an exemplary form of the container 24 of FIG. 2 in more detail. The container 24 comprises, in this case, a seamless tubular form defining at least one structural wall 30 formed of a unitary composition of intumescent material, so that the structural wall or walls 30 will expand upon heating to release loose material contained therein. The container 30 is shown filled with loose anti-skulling material 26, such as a mixture of chromite sand (e.g. 60–80% by weight), silica sand, and carbon black (e.g. up to about 0.5% by weight). The ends of the seamless tubular form wall 30 are open initially, but are capped by caps 32 of readily heat-destructible material. The composition of the intumescent material is at least 15% expandable material such as graphite, mica, or perlite, and exemplary preferred compositions are typically (in weight percentages):

Figure 1:
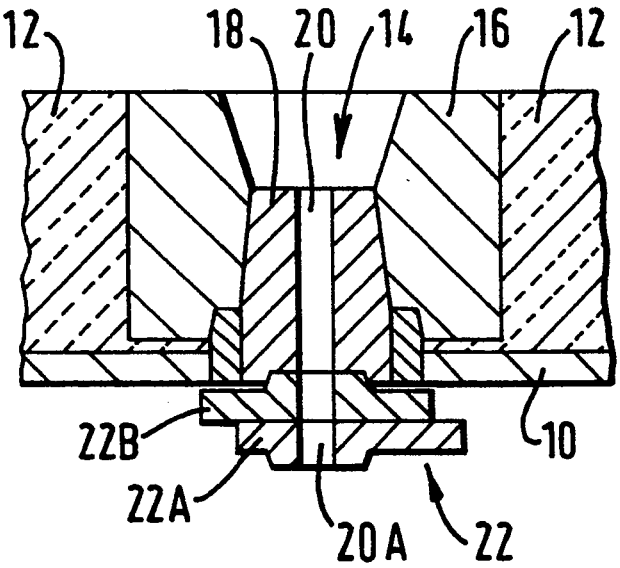
FIG. 1 is a diagrammatic cross-section through part of the base of a ladle showing the outlet nozzle zone.
Figure 2:
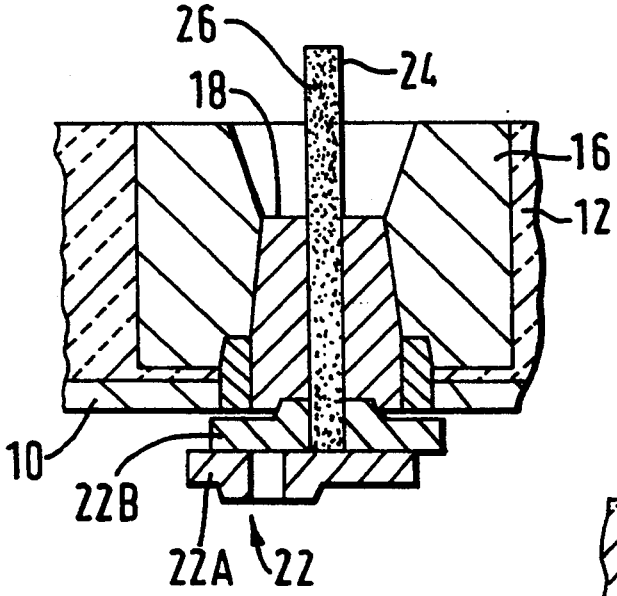
FIG. 2 shows the nozzle zone of FIG. 1 containing a container of the invention prior to heating.
Figure 3:
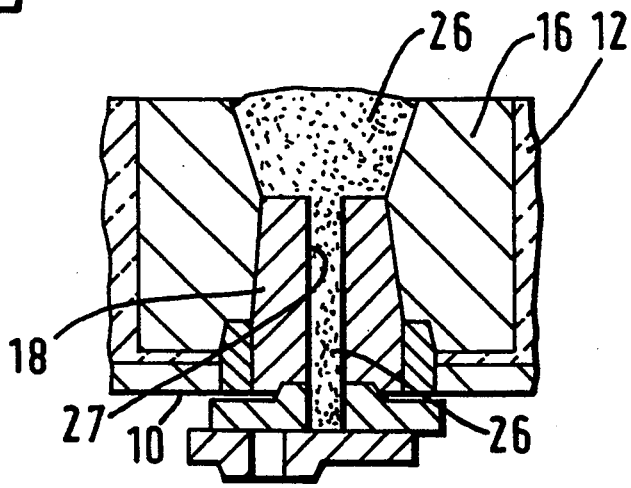
FIG. 3 is a similar view to FIG. 2 after heating of the nozzle zone and FIG. 4 is a perspective exploded view of an exemplary container of intumescent material according to the invention filled with anti-skulling material.
Figure 4:
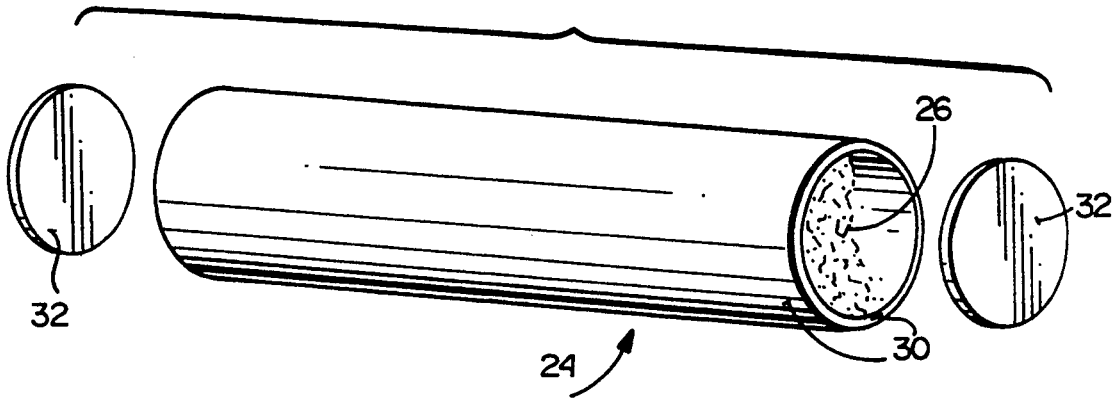

| | |
|---|---|
| expandable perlite or mica | 30–85 |
| inorganic binder | 10–70 |
| organic binder | 0–30 |
| inorganic fibrous material | 0–60–or alternatively |
| expandable graphite | 15–70 |
| organic binder | 5–40 |
| inorganic fibrous material | 0–30 |
| fire and smoke suppressant | 0–30.-- |

We claim:

1. A container, comprising:

at least one structural container wall for containing an anti-skulling material therein, said at least one structural wall being formed of the following composition in percentages by weight:

| | |
|---|---|
| expandable perlite | 30–85 |
| inorganic binder | 10–70 |
| organic binder | 0–30 |
| inorganic fibrous material | 0–60 |

so that the container walls are intumescent and will expand upon heating to release anti-skulling material therein; and wherein said container walls define a volume large enough to contain enough loose anti-skulling material to adequately fill the outlet nozzle zone of a metallurgical pouring vessel, having an outlet nozzle with a bore, with which the container is used.

2. A container as recited in claim 1 wherein the container comprises a seamless tubular form having open ends opposite each other; and further comprising caps of readily heat-destructible material closing said container open ends.

3. A container, comprising:

at least one structural container wall for containing an anti-skulling material therein, all structural walls formed of a unitary composition of intumescent material, so that said structural walls will expand upon heating to release loose material contained therein; and wherein said at least one container structural wall defines a volume large enough to contain enough loose anti-skulling material to adequately fill the outlet nozzle zone of a metallurgical pouring vessel having an outlet nozzle with a bore with which the container is used.

4. A container as recited in claim 3 wherein said intumescent material includes at least 15% by weight of an expandable material.

5. A container as recited in claim 4 wherein said expandable material is expandable graphite, expandable mica, expandable perlite, or mixtures thereof.

6. A container as recited in claim 3 wherein said intumescent material comprises the following composition in percentages by weight:

| | |
|---|---|
| expandable graphite | 15–70 |
| organic binder | 5–40 |
| inorganic fibrous material | 0–30 |
| fire and smoke suppressant | 0–30. |

7. A container as recited in claim 3 wherein the intumescent material has the following composition in percentages by weight:

| | |
|---|---|
| expandable mica | 30–85 |
| inorganic binder | 10–70 |
| organic binder | 0–30 |
| inorganic fibrous material | 0–60. |

8. A container as recited in claim 3 in which each of said at least one structural wall of intumescent material has a wall thickness of between 1–4 mm.

9. A container as recited in claim 8 wherein said container comprises a seamless tubular form.

10. A container as recited in claim 9 wherein said seamless tubular form has opposite open ends; and further comprising caps of readily heat-destructible material closing said container open ends.

11. A method of inhibiting the formation of skull in the outlet nozzle zone of a metallurgical pouring vessel having an outlet nozzle with a bore, comprising the steps of:

(a) providing a container comprising at least one structural container wall for containing an anti-skulling material therein, all structural walls formed of a unitary composition of material intumescent material, so that all structural walls will expand upon heating to release loose material contained therein;

(b) filling the container with loose anti-skulling material;

(c) placing the container in the outlet nozzle zone of the vessel to extend along the bore of the nozzle, leaving a gap between the container and the walls of the nozzle defining the bore; and (d) heating the container so that it expands to fill the gap, and release the anti-skulling material to adequately fill the outlet nozzle with anti-skulling material.

12. A method as recited in claim 11 wherein the container is longer than the length of the outlet nozzle zone, and wherein step (c) is practiced by positioning the container in the outlet nozzle zone so that the container extends into the interior of the vessel.

13. A method as recited in claim 11 wherein step (a) is practiced by forming a seamless tubular form.

14. A method as recited in claim 11 wherein step (a) is practiced to form a seamless tubular form with opposite open ends, and comprising the further step of capping the open ends with readily heat destructible material after the practice of step (b).

15. A method as recited in claim 11 wherein step (b) is practiced by filling the container with a mixture of chromite sand and silica sand.

16. A method as recited in claim 11 wherein step (b) is practiced by filling the container with a mixture of chromite sand, silica sand, and carbon black.

17. A method as recited in claim 11 wherein step (c) is practiced to place the filled container in the bore of the nozzle so that its lower end rests on a plate of a closed sliding gate valve attached to the underside of the vessel.

18. A method as recited in claim 11 wherein steps (a)–(d) are practiced so that after the practice of step (d) the container leaves a thin carbon coating on the walls defining the bore.

19. A container as recited in claim 3 in combination with an anti-skulling material filling the container, said anti-skulling material comprising a mixture of chromite sand and silica sand.

20. A container according to claim 19, in which the anti-skulling material contains from 60 to 80 per cent by weight of chromite sand.

21. A container according to claim 19, in which the anti-skulling material contains up to 0.5 per cent by weight of carbon black.

* * * * *